United States Patent [19]

Hagedorn

[11] 4,083,164

[45] Apr. 11, 1978

[54] CLIPPING MACHINE FOR CLOSING BAGS

[76] Inventor: Ewald Hagedorn, Berzeliusstrasse 89, 2 Hamburg 74, Germany

[21] Appl. No.: 798,265

[22] Filed: May 18, 1977

[30] Foreign Application Priority Data

Oct. 21, 1976 Germany ..... 2647598

[51] Int. Cl.[2] ..... B65B 61/00; B23P 11/00

[52] U.S. Cl. ..... 53/138 A; 29/33.5; 29/243.56; 29/243.57

[58] Field of Search ..... 53/138 A; 29/33.5, 243.5, 29/243.56, 243.57

[56] References Cited

U.S. PATENT DOCUMENTS

| | | | |
|---|---|---|---|
| 1,551,525 | 8/1925 | Hamer | 53/138 A X |
| 3,783,583 | 1/1974 | Dobbert | 53/138 A |

*Primary Examiner*—Travis S. McGehee

*Attorney, Agent, or Firm*—Prutzman, Hayes, Kalb & Chilton

[57] ABSTRACT

A clipping machine, of the type used for closing bags and such objects as sacks and tubes by means of wire clips which are placed in a U-shape around the gathered end or neck of the objects to be closed and then are bent together around this end, is provided for use in the conveyor line of automatic packaging equipment and is characterized by having a movable die mounted on a swivel so that it can be moved between a first position at the forward end of a gate passageway through which the object is moved by a conveyor belt and where the clip is secured thereto by a punch and a second position away from the forward end of the gate passageway to permit the object to exit in the same direction as it entered. The punch and die are power driven and may be automatically controlled for desired sequence of operation response to the passage of an object through the guide.

4 Claims, 2 Drawing Figures

CLIPPING MACHINE FOR CLOSING BAGS

BACKGROUND AND SUMMARY OF THE INVENTION

This invention relates to a machine for closing bags and such objects as sacks and tubes by means of wire clips which are placed in a U-shape around the gathered end or neck of the bags to be closed and then are bent together around this end.

The known clipping machines for securing a clip around the gathered ends or necks of bags and the like are usually provided with a fixed die, a guide which is set or directed towards the die in which the U-shaped clips with the parallel leg in front are pushed by a punch against the die, and a gate opening in which the gathered end of the bag to be closed can be moved up to the die and into the said guide. At the entrance end opposite to the die the gate is wide, so that the end of the bag to be closed can be inserted easily, and at the other end, it is narrow and closed by the stationary die. The narrow end is in the guide and is narrower than the space between the legs of the clips. Therefore, a clip pushed forward by the punch in the guide slides past with its legs on both sides of the bag end which is in the narrow end of the gate opening. With continued movement of the punch, the legs reach the die and are bent together by this, until the clip closes tightly and firmly around the bag end.

These known machines have the disadvantage that, after the clipping process, the end of the bag to be closed must be moved out of the gate opening in the opposite direction to the direction in which it was inserted. Therefore, they are not suited for automatic packaging units where it is desirable for the bags which are to be closed to be conveyed in a continuous movement in one direction by a conveyor.

An object of the invention is to create a clipping machine which can be used in automatic packaging units. A further object of the invention is to create a clipping machine of this kind which can be controlled automatically. A further object of the invention is to create a clipping machine which is controlled by the movement of the goods to be clipped.

These and other objects are achieved by providing a die in a machine of the type previously described which is movable between a first position, in which it closes the narrow end of the gate opening, ready to function, and a second position, in which the narrow end of the gate opening is open. When the die is in the first position, it is ready to close a bag. The end of the bag to be closed can be inserted in one direction into the gate opening. After this, the punch is set in motion and the clip is closed around the gathered end of the bag. Then the die is moved into the second position, so that the closed bag end can leave the gate opening at the end which was previously closed by the die. Therefore, it is not necessary for the bag end to reverse its direction of movement.

The punch is set in motion by means of a pneumatic, hydraulic or electric power drive, and in a similar manner, the die can also be moved by means of a power drive. Preferably, the controls of the two drives are linked with each other in such a way that the die is moved from the first into the second position as soon as the punch has completed its clipping movement.

This invention makes it possible to install a clipping machine in the conveyor line of an automatic packaging unit, so that the bags to be closed which follow the conveyor line can enter the gate opening at one end and leave it at the other end. It can be arranged for the control of the power drives for the punch and the die to be actuated automatically when a bag end to be closed approaches the gate opening, or enters into it, or passes any other certain point on the conveyor line.

DESCRIPTION OF PREFERRED EMBODIMENT

Figure 1:
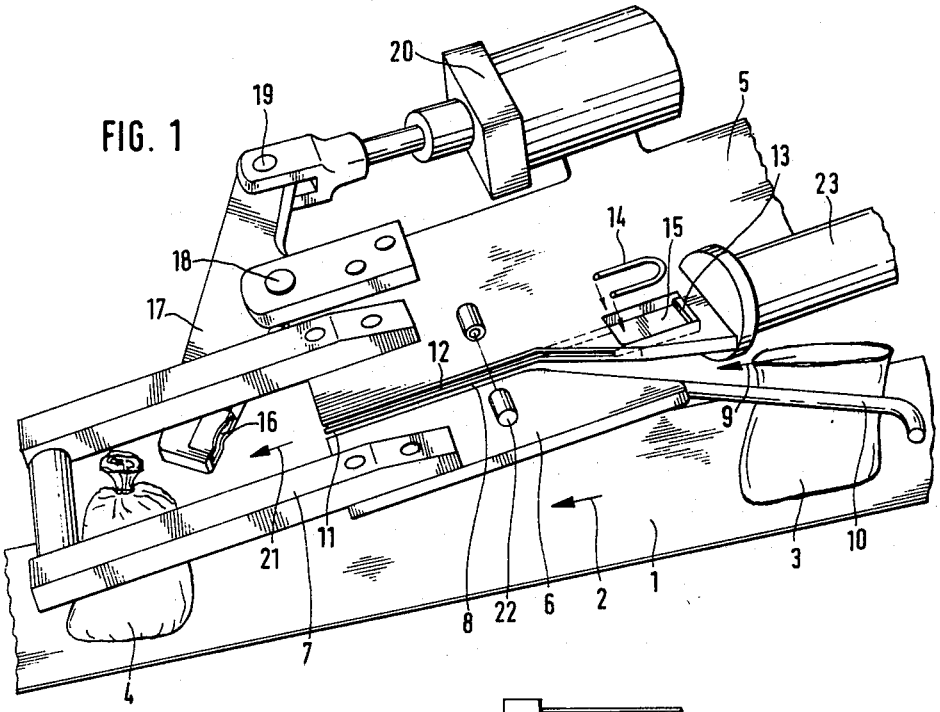
FIG. 1 is a perspective partial view of an apparatus embodying the invention.

The invention is explained more fully hereafter with reference to the drawing which illustrates an advantageous preferred embodiment of the invention.

Above a conveyor belt 1, which moves in the direction of the arrow 2 and conveys unclosed bag 3 to and closed bag 4 away from the machine, is disposed the apparatus of the present invention. This includes a main supporting plate 5, which is generally disposed horizontally and to which all other parts of the machine are attached. A further plate 6, which is attached rigidly to plate 5 and on the same level by a bracket 7, together with the main plate 5 encloses a slot 8, which forms the gate passageway. The gate passageway has a wide insertion end, which is symbolized by arrow 9, which at the same time indicates the direction in which the bag end of bag 3 to be closed enters the gate opening. One side of the gate passageway is lengthened by a guide bracket 10 in such a way that the objects to be closed, which move on the conveyor belt 1, are positively guided and inserted into the gate passageway. Before the outlet end 11 of the gate passageway is a narrow part of the gate passageway which proceeds in a straight line, and features grooves 12 on both sides forming a guide for a clip and the punch 13 aligned with the gate passageway. In both figures, the punch 13 is shown in the retracted position. In front of the punch 13 is an aperture 15 for inserting a clip 14 into the guide. This aperture can be connected to the outlet end of a clip magazine.

Figure 2:
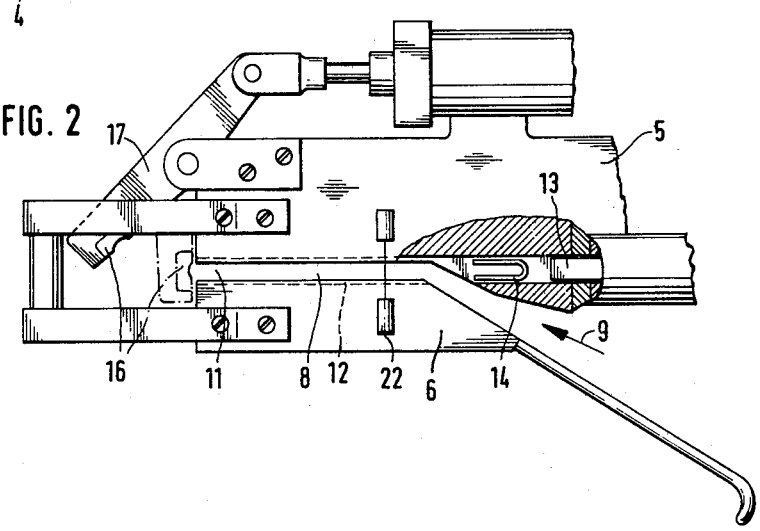
FIG. 2 shows a top plan view, partially in section, of the part of the machine shown in FIG. 1.

Before the outlet end 11 of the gate passageway, is a die 16 which is attached firmly to one end of a swivel lever 17, which can be swivelled, by means of an operating pneumatic drive 20 attached to the other end of the lever, around the swivel 18 which is attached firmly to the supporting plate 5. The arrangement is such that, on the one hand, the die 16 and lever 17 can take up the open position shown by the solid continuous lines and, on the other hand, the closed position indicated by the broken lines in FIG. 2. In the latter position, the die 16 is directly next to the outlet end 11 of the gate guide 8.

When the die 16 is closed and the punch 13 pushes a clip 14 forward through the guide 12 up to the die 16, the legs of the clip 14 will first encircle an object to be clipped, which is in the gate passageway 8 and then will move it to the die 16, whereby the object is gathered. When the clip is moved against the die 16 by the further thrust of the punch, its legs are bent and formed by the die around the object to be clipped until the clip enclasps the object firmly.

According to the invention, the die 16 can, after this process, be swivelled and removed from the outlet end 11 of the gate passageway 12 into the open position, whereby the clipped object has the opportunity to depart in the direction of arrow 21. The bracket 7 is located in such a way that it does not hinder the object in this movement.

The guide bracket 10, gate 9 and slot 8 are arranged lengthwise to and at such a height above the conveyor belt that the open ends of the bags 3 pass into the slot 8 by their forward movement and without human or mechanical aid.

The operaion of the apparatus can easily be automated by placing a sensing device for example an electric eye 22, which senses the entrance of a bag into the gate passageway, in a suitable position on the conveyor line of the bag 3. For example, a control device may be linked to the electric eye 22 in such a way that when the object entering the gate passageway cuts the beam of the electric eye, the die 16 is moved by means of the drive 20 into the closed position. When the beam of the electric eye is unbroken again, because the object has passed the electric eye completely and has entered the long, narrow part of the gate passageway in front of the die 16, the drive 23 of the punch 13 is actuated. This pushes the clip 14 forward and thus effects the closing of the object. Then both drives 20 and 23 retract so that the die 16 is removed from the outlet end 11 of the gate passageway and thus vacates the way 21 for the closed object, and punch 13 is retracted from the gate passageway and thus vacates the way for the next object to be closed.

The application of the invention is not intended to be limited to the specific arrangement described above. For example, it will be apparent that a vertical conveyor or one that is set at a different angle can be fitted for the objects to be clipped with a corresponding alignment of the gate passageway. The means of conveyance for the objects to be clipped also may be varied to suit the nature of these objects, which on the other hand can affect the design of the means of control for the machine. The machine can also be used for other objects than bag ends to be closed, such as the ends of sausages, for example, or for elongated objects such as bundles of wire.

As will be apparent to persons skilled in the art, various modifications, adaptations and variations can be made from the foregoing specific disclosure without departing from the teachings of the present invention.

I claim:

1. A clipping machine for closing bags and similar objects comprising a gate passageway through which the neck of an object to be closed is adapted to pass, said gate passageway having an enlarged entrance end and a narrow exit end, a guide in alignment with the gate passageway for receiving and guiding a U-shaped clip toward the exit end of the gate passageway, a punch mounted for movement longitudinally of the guide for driving a clip toward said exit end, and a die mounted for movement between a first position at the exit end of the gate passageway for cooperation with the punch, and a second position removed from the narrow end of the gate passageway for permitting the object to exit therefrom.

2. A clipping machine as defined in claim 1 wherein power drive means is provided for actuating the punch and die and arranged to move the die from the first position to the second position as soon as the punch has completed its clipping movement.

3. A clipping machine as defined in claim 2 wherein a conveyor is provided to move an object through the gate passageway.

4. A clipping machine as defined in claim 3 wherein means is provided to actuate the power drive means automatically in response to movement of the object to be clipped through the gate passageway.

* * * * *